US012208940B1

(12) United States Patent
Kendall

(10) Patent No.: US 12,208,940 B1
(45) Date of Patent: Jan. 28, 2025

(54) STORAGE CONTAINER SYSTEM

(71) Applicant: Angela Kendall, Geneva, OH (US)

(72) Inventor: Angela Kendall, Geneva, OH (US)

( * ) Notice: Subject to any disclaimer, the term of this patent is extended or adjusted under 35 U.S.C. 154(b) by 0 days.

(21) Appl. No.: 18/048,590

(22) Filed: Oct. 21, 2022

(51) Int. Cl.
*B65D 21/02* (2006.01)
*B65D 43/02* (2006.01)
*B65D 51/16* (2006.01)

(52) U.S. Cl.
CPC ..... *B65D 21/0204* (2013.01); *B65D 43/0218* (2013.01); *B65D 51/1683* (2013.01); *B65D 2543/00194* (2013.01); *B65D 2543/005* (2013.01); *B65D 2543/00537* (2013.01); *B65D 2543/00555* (2013.01)

(58) Field of Classification Search
CPC ..... B65D 21/0204; B65D 21/0201; B65F 2001/0086
USPC ..... 220/23.2, 23.4
See application file for complete search history.

(56) References Cited

U.S. PATENT DOCUMENTS

| | | | | |
|---|---|---|---|---|
| 4,328,902 | A | 5/1982 | North | |
| 4,372,445 | A | 2/1983 | Keffeler | |
| 4,966,298 | A | 10/1990 | Von Holdt | |
| 5,339,976 | A | 8/1994 | Thornton | |
| 5,381,916 | A * | 1/1995 | Strawder | B65D 21/0202 220/212.5 |
| 6,029,843 | A | 2/2000 | Kroscher et al. | |
| 6,305,546 | B1 | 10/2001 | Saunders et al. | |
| 6,307,193 | B1 | 10/2001 | Toole | |
| 8,087,527 | B2 | 1/2012 | Johnson | |
| 10,173,826 | B2 | 1/2019 | Sexton et al. | |
| 11,180,284 | B2 | 11/2021 | Longo | |
| 2012/0285952 | A1* | 11/2012 | James | B65F 1/1468 220/23.4 |
| 2018/0319536 | A1 | 11/2018 | Robertson | |
| 2020/0039689 | A1 | 2/2020 | Leinbach | |

* cited by examiner

*Primary Examiner* — Jeffrey R Allen
(74) *Attorney, Agent, or Firm* — Dunlap Bennett & Ludwig, PLLC

(57) ABSTRACT

A novel container and container system is herein disclosed. Each container includes a main body, at least one male connection member, and at least one female connection member. The connection members are arranged on the main body in a manner that easily coupling of adjacent containers is facilitated, as well as a wide range of potential configurations of coupled containers.

11 Claims, 9 Drawing Sheets

STORAGE CONTAINER SYSTEM

BACKGROUND OF THE INVENTION

The present invention relates to storage containers and, more particularly, to a storage container system with containers that are selectively attachable and separable from one another for various purposes (e.g., heating).

At the present, oftentimes several types of food will be stored in a single container for storage or transport (e.g., taking lunch to work). For the purposes of containment of food, this is an adequate solution, but it becomes problematic when the user needs to heat or reheat only certain portions of the food, as it is either difficult or impossible to separate the food (even with compartmented containers). As the food stored in the containers change daily, so too do the specific heating needs of the user. Further, separate detached containers are inconvenient to deal with, as they can easily become separated.

As can be seen, there is a need for a storage container system as detailed herein. The present invention solves the problem of carrying foods that have disparate heating or storage needs as part of the same overall system.

SUMMARY OF THE INVENTION

In one aspect of the present invention, a container is disclosed that includes: a main body defining a storage space; a first male connection member disposed on a first side of the main body and comprising: a male upper member coupled to or integral with the main body; and a tab coupled to or integral with the male upper member and extending downwardly therefrom; and a first female connection member disposed on a second side of the main body and comprising: a female upper member coupled to or integral with the main body; and a tab-receiving lower member coupled to or integral with the female upper member and extending downwardly therefrom, with the female upper member and the tab-receiving lower member defining a hole therethrough.

In another aspect of the present invention, a container system is disclosed that includes: a first container comprising: a main body defining a storage space; a first male connection member disposed on a first side of the main body and comprising: a male upper member coupled to or integral with the main body; and a tab coupled to or integral with the male upper member and extending downwardly therefrom; and a first female connection member disposed on a second side of the main body and comprising: a female upper member coupled to or integral with the main body; and a tab-receiving lower member coupled to or integral with the female upper member and extending downwardly therefrom, with the female upper member and the tab-receiving lower member defining a hole therethrough; and a second container comprising: a main body defining a storage space; a first male connection member disposed on a first side of the main body and comprising: a male upper member coupled to or integral with the main body; and a tab coupled to or integral with the male upper member and extending downwardly therefrom; and a first female connection member disposed on a second side of the main body and comprising: a female upper member coupled to or integral with the main body; and a tab-receiving lower member coupled to or integral with the female upper member and extending downwardly therefrom, with the female upper member and the tab-receiving lower member defining a hole therethrough, wherein the tab of the first container is selectively insertable through the hole of the second container to retain the first container and the second container together.

These and other features, aspects and advantages of the present invention will become better understood with reference to the following drawings, description, and claims.

BRIEF DESCRIPTION OF THE DRAWINGS

The following figures are included to illustrate certain aspects of the present disclosure and should not be viewed as exclusive embodiments. The subject matter disclosed is capable of considerable modifications, alterations, combinations, and equivalents in form and function, without departing from the scope of this disclosure.

FIG. 1(*b*) is a top rear perspective and detail view of the embodiment of the present invention, showing a female component thereof in use on the first container;

FIG. 1(*c*) is a bottom rear perspective and detail view of the embodiment of the present invention, showing the female component thereof in use on the first container;

DETAILED DESCRIPTION OF THE INVENTION

Figure 1C:
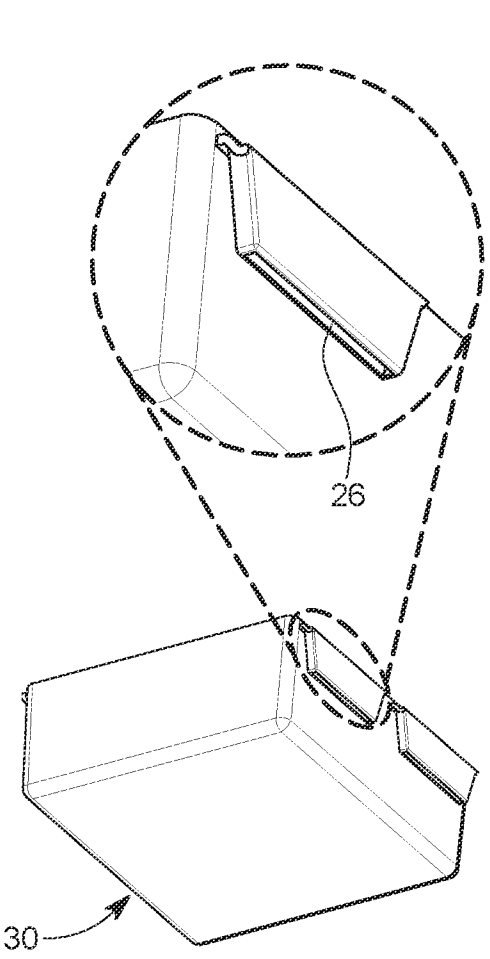
FIG. 1(*a*) is a top front perspective and detail view of an embodiment of the present invention, showing a male component thereof in use on a first container.

The subject disclosure is described with reference to the drawings, wherein like reference numerals are used to refer to like elements throughout. In the following description, for purposes of explanation, numerous specific details are set forth in order to provide a thorough understanding of the present disclosure such that one skilled in the art will be enabled to make and use the present invention. It may be evident, however, that the present disclosure may be practiced without some of these specific details. For the purpose of clarity, technical material that is known in the technical fields related to the present invention has not been described in detail so that the present invention is not unnecessarily obscured.

As discussed above, currently available food storage containers do not allow individuals to carry both hot and cold food items together in one convenient unit. The present invention allows consumers to store and carry warm, cold and room temperature foods (or multi-temperature foods) together. For example, warm foods can be re-heated in a detachable container for ultimate convenience without disturbing the temperature of the other items. Cold foods can be put in a refrigerator for storage. Once detachment is no longer needed, the containers can be simply snapped back together via the novel connection process disclosed herein. Various size containers may be provided to permit optimized adaptability and convenience for the end-user.

The present invention features a novel connection mechanism (with unique male and female components) that has many advantages over the prior art. First, it permits easy connection and detachment of containers. Second, due to its unique construction, adjacent containers can be connected while not interfering with the presence of a lid on one or both adjacent containers. Third, the connection mechanism is designed in such a way that various arrangements of containers can be attained, based on the ever-changing needs of the end-user. Various sizes and structure variations can be selected, making it significantly easier to reheat, refrigerate and, in general, store items.

Figure 1B:
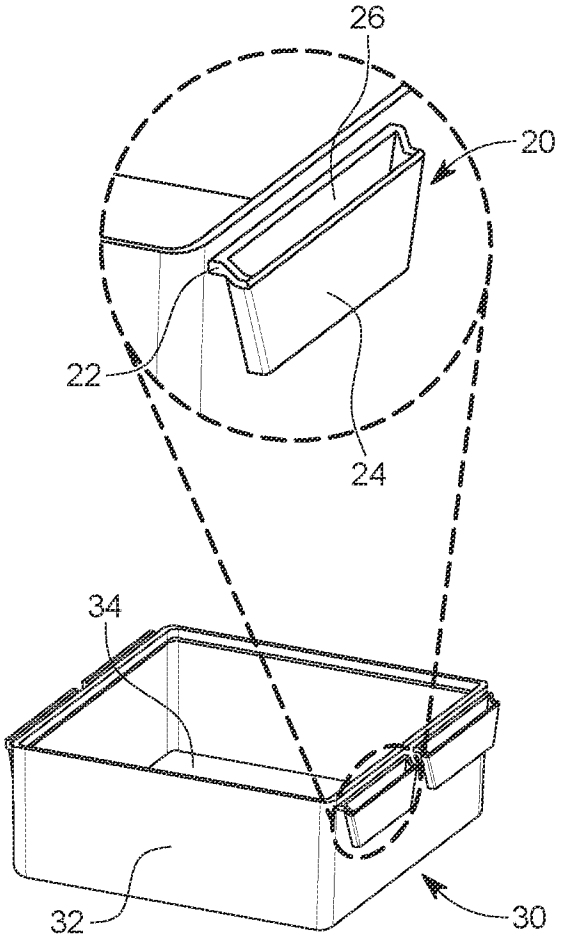
Figure 1A:
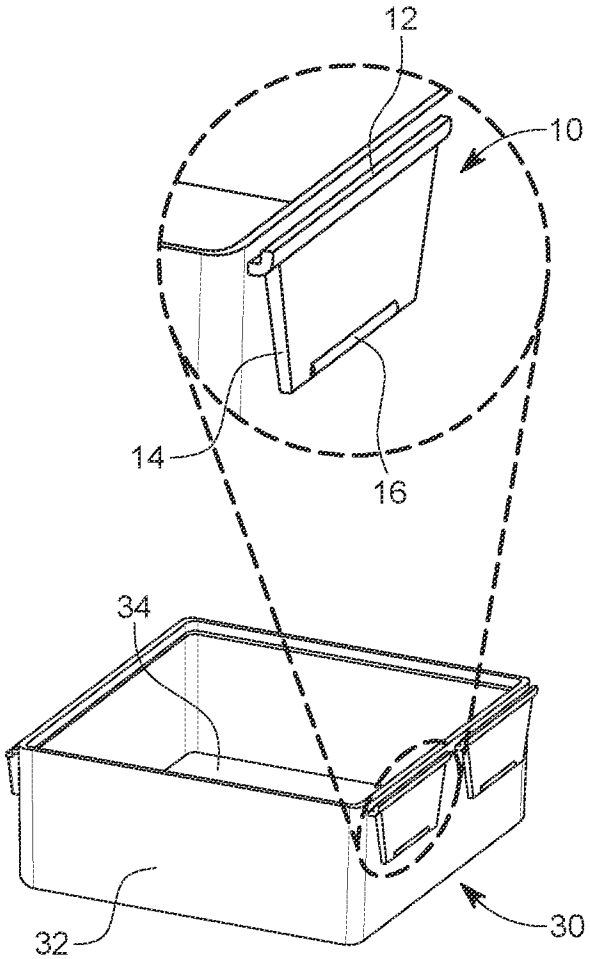
Figure 2:
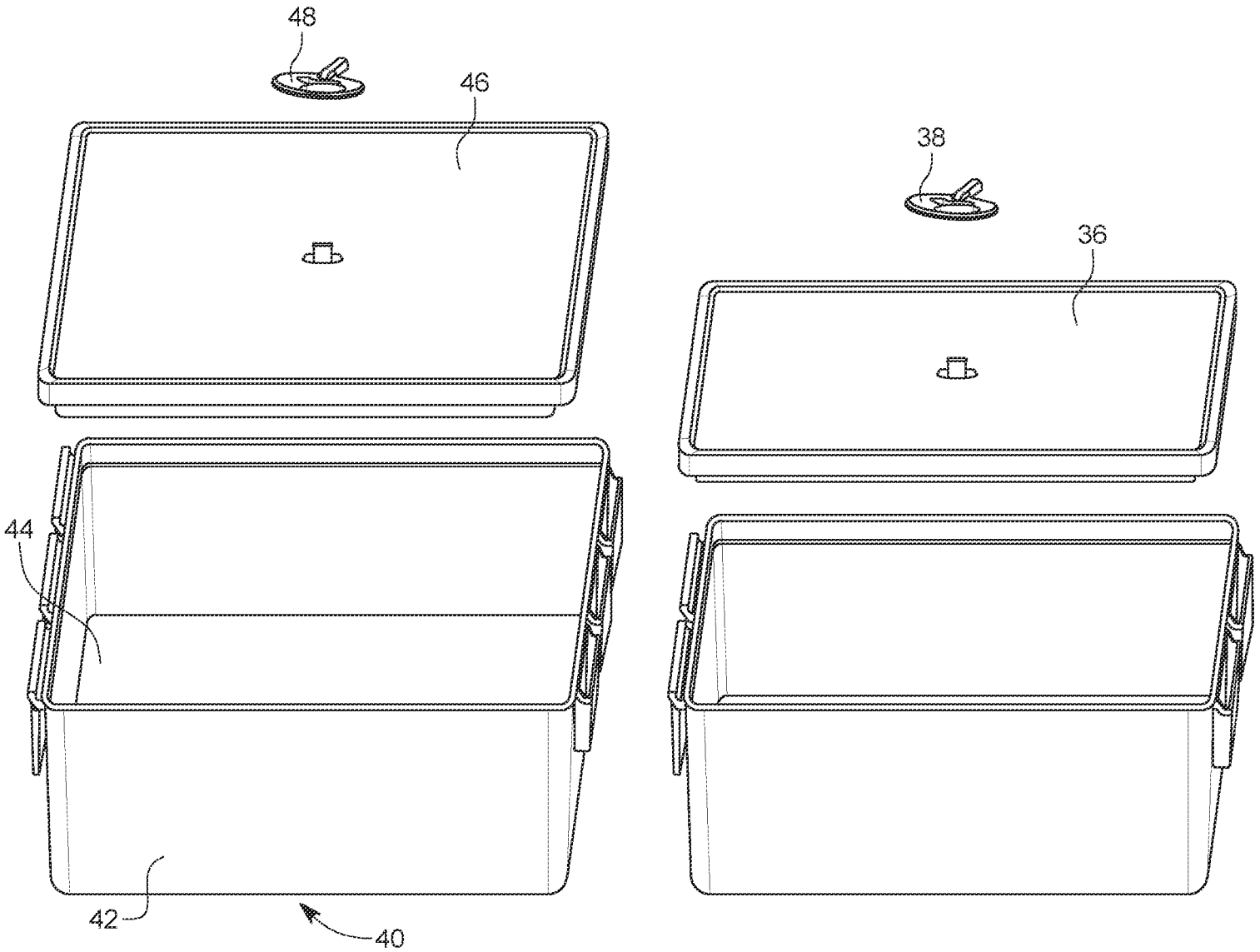
FIG. 2 is an exploded perspective view of the embodiment of the present invention, shown in use on the first container and a second container.

Referring now to FIGS. 1(*a*)-(*c*), a first container 30 generally includes a main body 32 that defines a storage space 34 therein. As discussed above, the storage space 34 is primarily intended to retain various foods, but those with skill in the art will appreciate that it may be used for any appropriate retention purpose. As shown in FIGS. 2-5, the first container 30 also includes a lid 36 with an integrated vent 38. The first container 30 has, on outer sides of the main body 32, a connection mechanism 10, 20 that enables selective coupling of adjacent containers 30, 40, 50, 60. It is noted that, depending upon the specific figure(s) referred to, references to different containers are made. Unless otherwise noted, the connection mechanism structure and the actual container designs are consistent across the types, with the differences being in the lengths/widths of the containers and number of connection members used. With that in mind, on a first outer side of the main body 32 is one or more male connection members 10 and on a second, opposite outer side of the main body 32 is one or more female connection members 20.

The male connection member 10 includes a lid-accommodating upper member 12 (which couples to the main body 32) and an elongated lower tab 14. As shown in FIGS. 1(*a*), 4 and 5, the upper member 12 includes an upwards bend to generally define a recess in which a portion of an outer lip of the lid 36 can be received, in use. The lower tab 14 projects downwardly from an outer portion of the upper member 12 and may be coupled to or integral therewith. At a lower end of the tab 14 is an outwardly extending protrusion 16.

Figure 5:
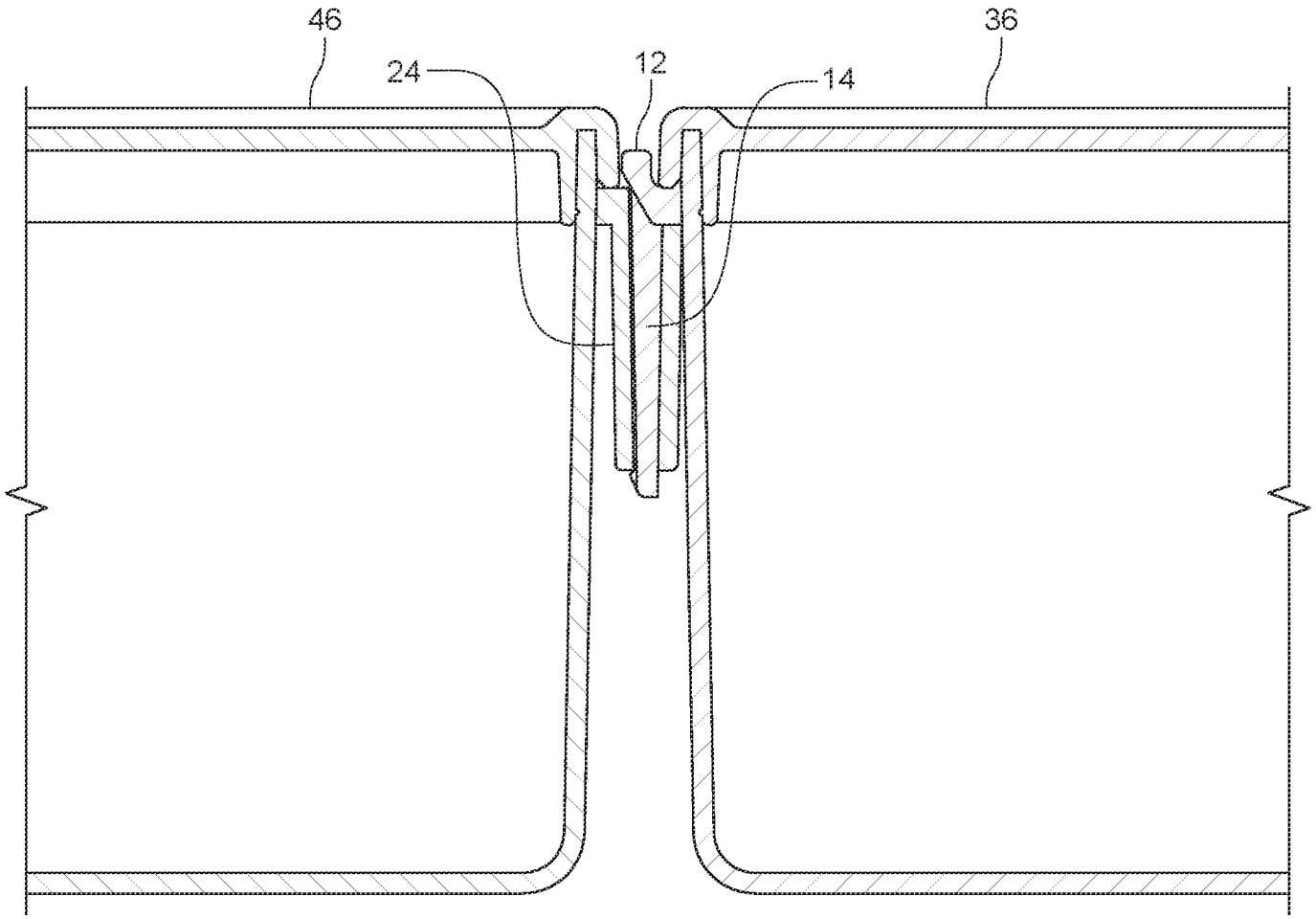
FIG. 5 is a detail cross-sectional view of the embodiment of the present invention, taken along line 5-5 of FIG. 4.
Figure 6:
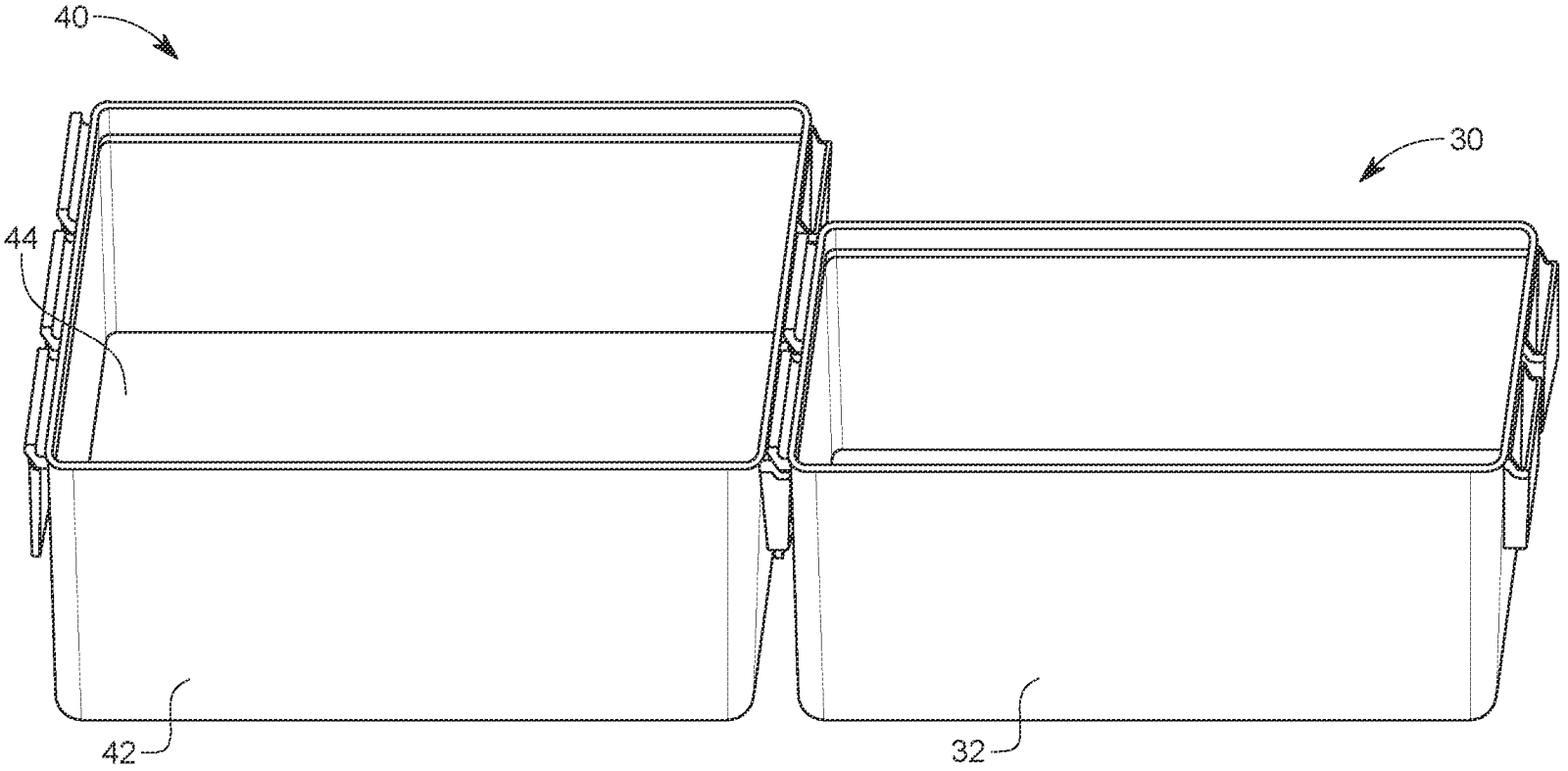
FIG. 6 is a perspective view of the embodiment of the present invention, similar to FIG. 4, but with lids of the first and second containers removed.

Making reference to FIGS. 1(*a*), 1(*c*), and 5, the female connection member 20 includes an upper member 22 (which couples to the main body 32/42) and a tab-receiving lower member 24. The upper member 22 and lower member 24 define a hole 26 through which the lower tab 14 extends, in use. As shown in FIG. 5, when the lid 46 is positioned on the main body 42, a bottom portion of the lid 46 abuts an upper surface of the upper member 22. Further, the bottom portion of the lid 46 nests between a sidewall of the main body 42 and an adjacent upper member 12. At an opposite side, and as demonstrated by the lid 32 in FIG. 5, another bottom portion of the lid 32 sits in the recess defined by the lid-accommodating upper member 12.

Figure 3:
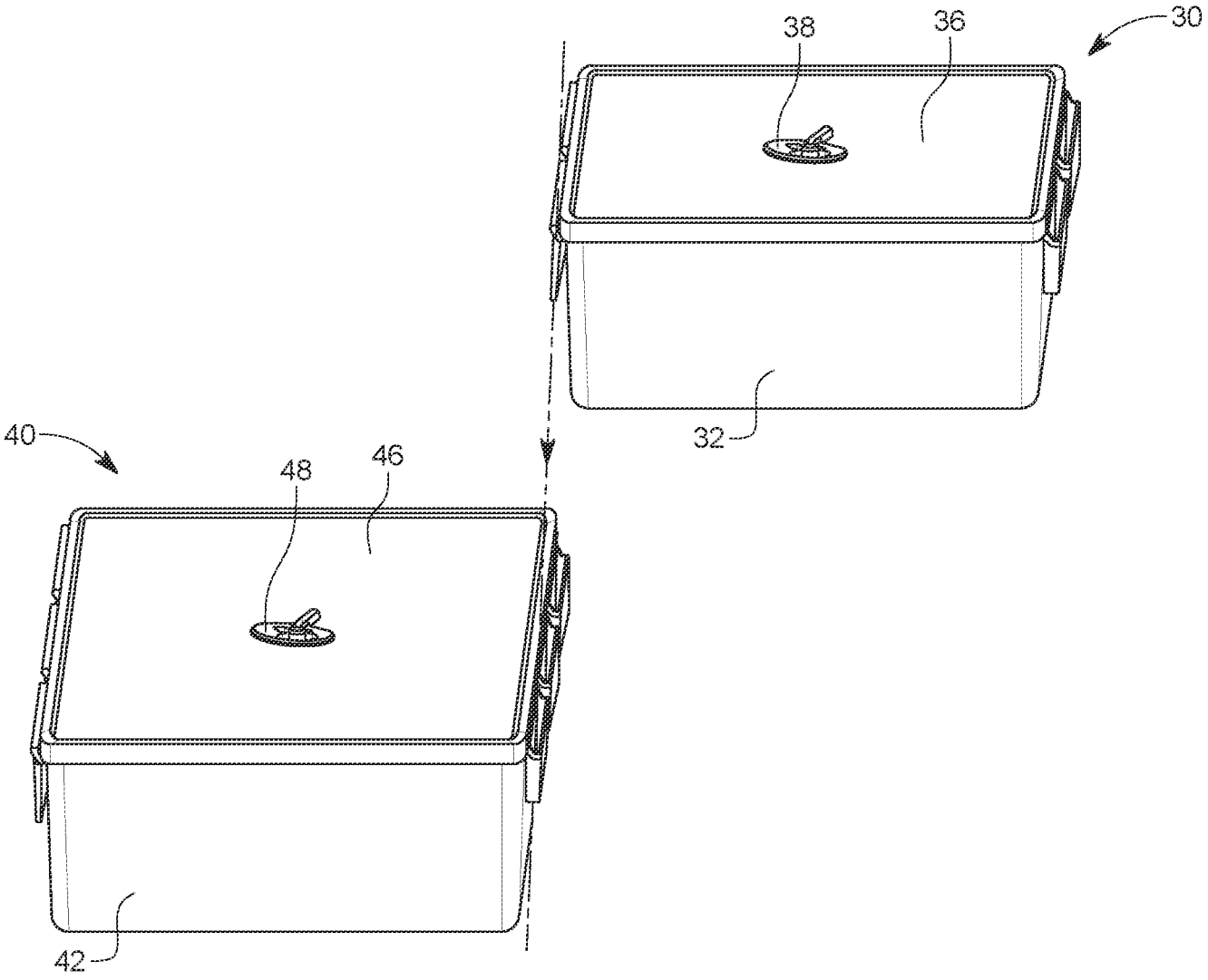
FIG. 3 is a perspective view of the embodiment of the present invention, showing a coupling action of the first container and the second container.
Figure 4:
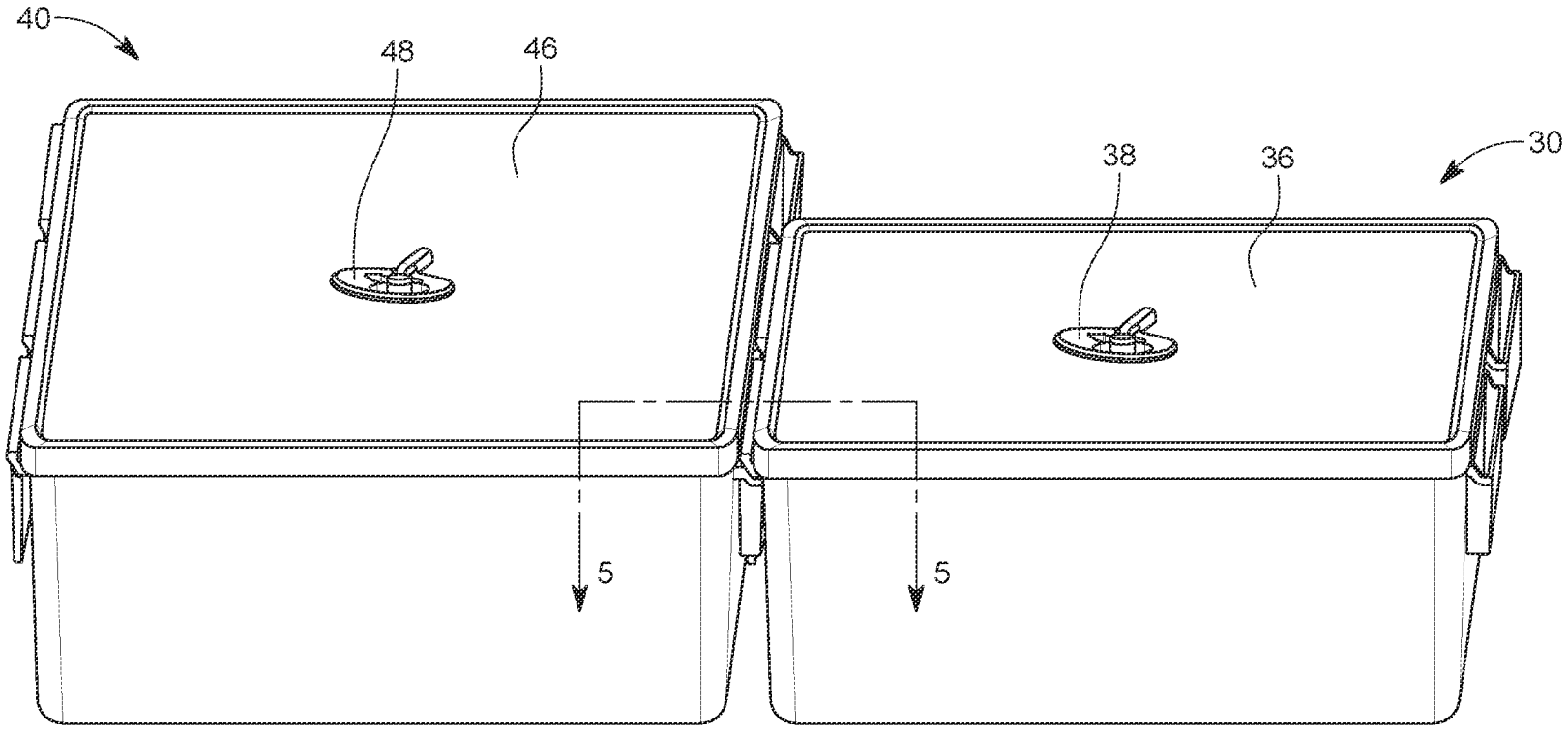
FIG. 4 is a perspective view of the embodiment of the present invention, similar to FIG. 3, showing the first container and the second container coupled to one another.

As shown by the directional arrow in FIG. 3, conveniently, the connection mechanism 10, 20 allows adjacent containers 30, 40 to be connected to one another without the need for removal of either of the lids 36, 46. The male connection member 10 can be moved downwardly to engage the lower tab 14 in the hole 26. When this occurs, the protrusion 16 snaps with a lower edge of the tab-receiving lower member 24, locking the two containers 30, 40 to one another. To detach the containers 30, 40, upward pressure is applied to the first container 30, which releases the protrusion 16 and allows the first container 30 to be lifted from the second container 40.

Figure 7:
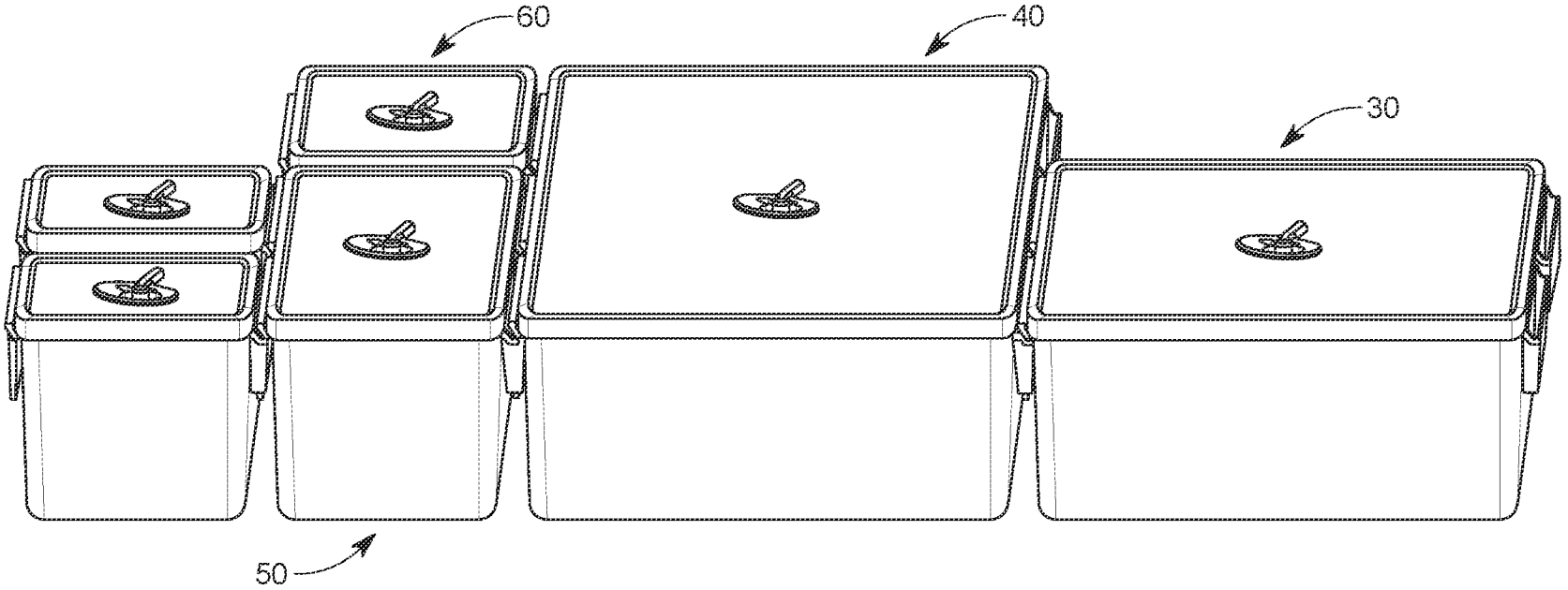
FIG. 7 is a perspective view of the embodiment of the present invention, shown in use on the first container, the second container, a third container, and three fourth containers in a first configuration.
Figure 8:
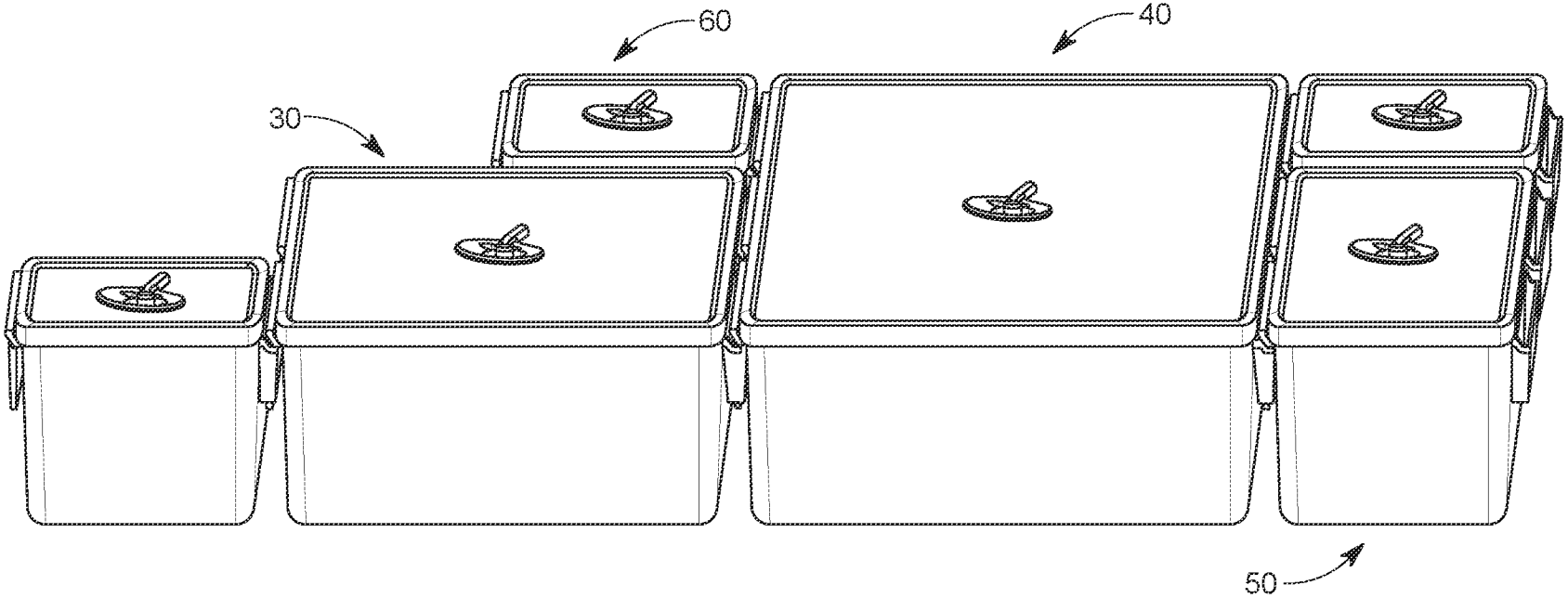
FIG. 8 is a perspective view of the embodiment of the present invention, shown in use on the first container, the second container, the third container, and the three fourth containers in a second configuration.
Figure 9:
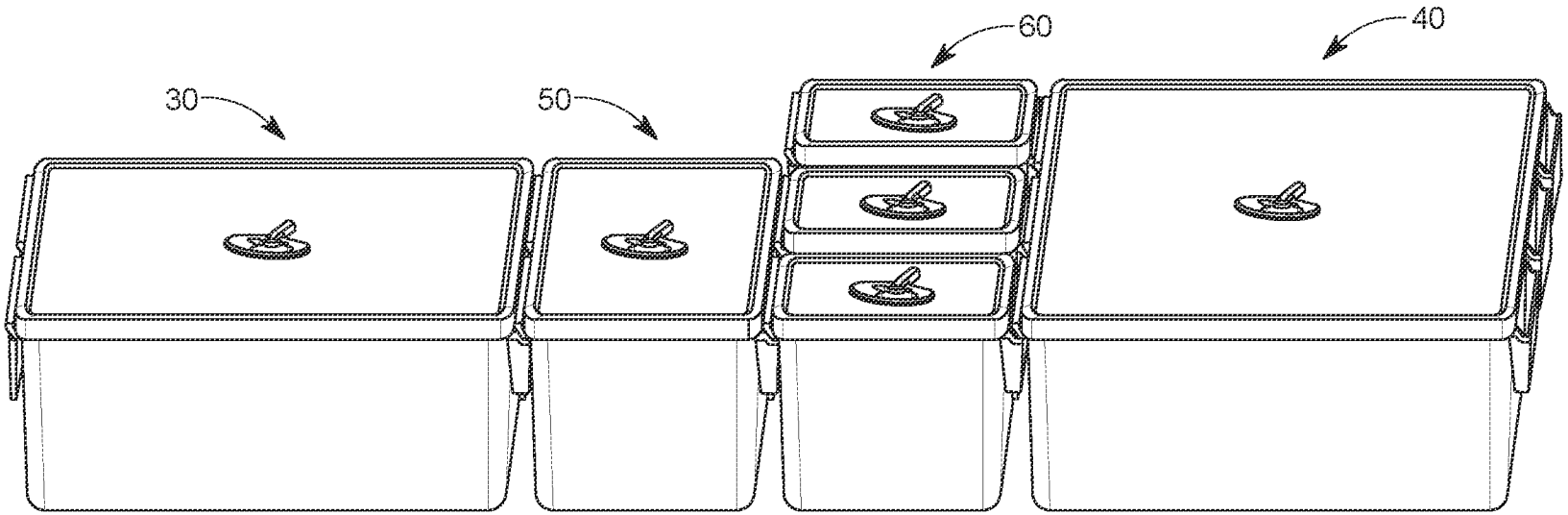
FIG. 9 is a perspective view of the embodiment of the present invention, shown in use on the first container, the second container, the third container, and the three fourth containers in a third configuration.

As shown in FIGS. 6-9, a plurality of containers 30, 40, 50, 60 can be provided as part of an overall storage system of the present invention, with the containers having varying widths. Accordingly, based on the respective width of the container, a single female connection member 20 and male connection member 10 may be provided (container 60), two female connection members 20 and male connection members 10 may be provided (containers 30 and 50, which are wider than container 60), three female connection members 20 and male connection members 10 may be provided (container 40, which is wider than containers 30 and 50), etc. Further, as demonstrated by container 30 and container 50, respective lengths of the containers may be varied in accordance with the present invention. FIGS. 7-9 demonstrate just a few of the potential arrangements the present invention may employ.

As will be appreciated, the connection mechanisms 10, 20 may be arranged on any side of the container such the aforementioned functionality is enabled. In preferred embodiments, the containers are formed from a dishwasher and microwave safe material, such as polycarbonate plastic. Injection molding or any other appropriate manufacturing method may be utilized. Further, the present invention, besides use with food products, may have utility as storage for other items.

In certain embodiments, different lid sets may be provided that are selectable by the end user based on used of container sets. For example, the lids may be embodied with days of the week designs, so a user never has to wonder which day they stored leftovers in the refrigerator. Further, trendy designs/indicia may be used, such as—"let's eat", "tasty", "sweet treats", "homemade", "leftovers", etc. Further, a full range of holiday sets may be provided.

In an exemplary use case, the first container 30 may be used to hold a hot food item, such as spaghetti, soup, taco filling, meatloaf, etc. The second container 40 may be used to hold a cold food item, such as a salad, fruit, cheese, etc. Both containers 30, 40 can be covered with a lid and snapped together and taken to work for storage in a refrigerator. When ready for consumption, the containers 30, 40 can be detached and the first container 30 heated up (with the vent 38) opened. After microwaving is completed, the entire meal can be enjoyed by the user. Once finished, the containers 30, 40 can be easily snapped back together for convenient retention and transport.

While one or more preferred embodiments are disclosed, many other implementations will occur to one of ordinary skill in the art and are all within the scope of the invention. Each of the various embodiments described above may be combined with other described embodiments in order to provide multiple features. Furthermore, while the foregoing describes a number of separate embodiments of the apparatus and method of the present invention, what has been described herein is merely illustrative of the application of the principles of the present invention. Other arrangements, methods, modifications, and substitutions by one of ordinary skill in the art are therefore also considered to be within the scope of the present invention, which is not to be limited except by the claims that follow.

While apparatuses and methods are described in terms of "comprising," "containing," or "including" various components or steps, the apparatuses and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usage of a word or term in this specification and one or more patent or other documents that may be incorporated herein by reference, the definitions that are consistent with this specification should be adopted. Moreover, the use of directional terms such as above, below, upper, lower, upward, downward, left, right, and the like are used in relation to the illustrative embodiments as they are depicted in the figures, the upward or upper direction being toward the top of the corresponding figure and the downward or lower direction being toward the bottom of the corresponding figure.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A container comprising:
- a main body defining a storage space;
- a first male connection member disposed on a first side of the main body and comprising:
  - a male upper member coupled to or integral with the main body;
  - a tab coupled to or integral with the male upper member and extending downwardly therefrom; and
  - a protrusion extending outwardly from a distal portion of the tab; and
- a first female connection member disposed on a second side of the main body and comprising:
  - a female upper member coupled to or integral with the main body; and
  - a tab-receiving lower member coupled to or integral with the female upper member and extending downwardly therefrom, with the female upper member defining an upper hole and the tab-receiving lower member defining a lower hole, wherein the protrusion slides through the lower hole to form a snap lock condition.

2. The container of claim 1, further comprising a second male connection member and a second female connection member.

3. The container of claim 2, wherein the second male connection member is arranged adjacent the first male connection member and the second female connection member is arranged adjacent the first female connection member.

4. The container of claim 3, further comprising a third male connection member and a third female connection member.

5. The container of claim 1, wherein the male upper member has an upwards bend to define a recess, whereby a distal edge of the male upper member is upward of a remainder of the male upper member.

6. The container of claim 5, further comprising a lid that comprises an outer lip, with a portion of the outer lip being received in the recess when the lid entirely covers an opening communicating the storage space with an external environment.

7. The container of claim 6, wherein another portion of the outer lip selectively abuts an upper edge of the female upper member.

8. A container system comprising:
- a first container comprising:
  - a main body defining a storage space;
  - a first male connection member disposed on a first side of the main body and comprising:
    - a male upper member coupled to or integral with the main body; and
    - a tab coupled to or integral with the male upper member and extending downwardly therefrom;
    - a protrusion extending outwardly from a distal portion of the tab; and
  - a first female connection member disposed on a second side of the main body and comprising:
    - a female upper member coupled to or integral with the main body; and
    - a tab-receiving lower member coupled to or integral with the female upper member and extending downwardly therefrom, with the female upper member defining an upper hole and the tab-receiving lower member defining a lower hole, wherein the protrusion slides through the lower hole to form a snap lock condition; and
- a second container comprising:
  - a main body defining a storage space;
  - a first male connection member disposed on a first side of the main body and comprising:
    - a male upper member coupled to or integral with the main body; and
    - a tab coupled to or integral with the male upper member and extending downwardly therefrom; and
  - a first female connection member disposed on a second side of the main body and comprising:
    - a female upper member coupled to or integral with the main body; and
    - a tab-receiving lower member coupled to or integral with the female upper member and extending downwardly therefrom, with the female upper member and the tab-receiving lower member defining a hole therethrough, wherein the tab of the first container is selectively insertable through the hole of the second container to retain the first container and the second container together.

9. The container system of claim 8, further comprising: a third container retained to the second container via to the first male connection member of the second container.

10. The container system of claim 1, wherein the first male and first female connections are disconnected from a lid for covering an opening communicating the storage space to an external environment.

11. The container system of claim 5, where in the snap lock condition the distal edge of the male upper member is upward of the first female connection member.

* * * * *